US006401447B1

(12) United States Patent
Rice et al.

(10) Patent No.: US 6,401,447 B1
(45) Date of Patent: Jun. 11, 2002

(54) COMBUSTOR APPARATUS FOR A GAS TURBINE ENGINE

(75) Inventors: Edward C. Rice, Indianapolis, IN (US); Spencer D. Pack, Middletown, CT (US)

(73) Assignee: Allison Advanced Development Company, Indianapolis, IN (US)

( * ) Notice: Subject to any disclaimer, the term of this patent is extended or adjusted under 35 U.S.C. 154(b) by 7 days.

(21) Appl. No.: 09/708,945

(22) Filed: Nov. 8, 2000

(51) Int. Cl.[7] ..... F02C 7/20
(52) U.S. Cl. ..... 60/39.31; 60/39.32; 60/751
(58) Field of Search ..... 60/39.32, 39.36, 60/751, 746, 39.31

(56) References Cited

U.S. PATENT DOCUMENTS

| | | | | |
|---|---|---|---|---|
| 3,750,397 A | | 8/1973 | Cohen et al. | |
| 3,780,529 A | | 12/1973 | Johnson | |
| 3,877,221 A | | 4/1975 | Lefebvre et al. | |
| 4,177,637 A | | 12/1979 | Pask | |
| 4,458,479 A | | 7/1984 | Reider et al. | |
| 4,512,158 A | * | 4/1985 | Striebel et al. | 415/914 |
| 5,211,003 A | * | 5/1993 | Samuel | 60/751 |
| 5,297,385 A | | 3/1994 | Dubell et al. | |
| 5,619,855 A | | 4/1997 | Burrus | |
| 5,701,733 A | | 12/1997 | Lewis et al. | |
| 5,956,955 A | * | 9/1999 | Schmid | 60/748 |
| 6,286,298 B1 | * | 9/2001 | Burrus et al. | 60/732 |

* cited by examiner

*Primary Examiner*—Charles G. Freay
(74) *Attorney, Agent, or Firm*—Woodard, Emhardt, Naughton Moriarty & McNett

(57) ABSTRACT

A combustor apparatus for a gas turbine engine includes a combustor liner support having an annular dome panel and a plurality of load transfer members extending axially therefrom. The dome panel maintains inner and outer combustor liners in spaced relation to define a combustion chamber. The load transfer members extend into a diffuser flowpath defined by inner and outer flowpath structures which are interconnected by a plurality of struts. Each of the load transfer members surrounds at least a portion of a corresponding strut to shield the strut from fluid flowing through the diffuser flowpath.

33 Claims, 6 Drawing Sheets

COMBUSTOR APPARATUS FOR A GAS TURBINE ENGINE

This invention was made with U.S. Government support under contract number F33615-97-C-2778 awarded by the United States Air Force, and the U.S. Government may have certain rights in the invention.

BACKGROUND OF THE INVENTION

The present invention relates generally to gas turbine engines. More particularly, the present invention relates to a combustor apparatus for a gas turbine engine. Although the present invention was developed for use in a gas turbine engine, certain applications of the invention may fall outside of this field.

A gas turbine engine is typical of the type of turbo machinery in which the present invention may be advantageously employed. In a conventional gas turbine engine, increased pressure fluid from a compressor is passed through a diffuser to condition the increased pressure fluid for subsequent combustion. The conditioned fluid is fed into a combustion chamber, which is typically defined by a combustor dome panel and inner and outer combustor liners. A series of fuel nozzles spray fuel into the combustion chamber where the fuel is intermixed with the conditioned fluid to form a combustion mixture. The combustion mixture is ignited and burned to generate a high temperature gaseous flow stream. The gaseous flow stream is discharged into a turbine section having a series of turbine vanes and turbine blades. The turbine blades convert the thermal energy from the gaseous flow stream into rotational kinetic energy, which in turn is utilized to develop shaft power to drive mechanical components, such as the compressor, fan, propeller, output shaft or other such devices. Alternatively, the high temperature gaseous flow stream may be used directly as a thrust for providing motive force, such as in a turbine jet engine.

In some prior combustor designs, the inner and outer combustor liners are supported at their upstream ends and their downstream ends are allowed to float relative to the first turbine vane or nozzle. A technique sometimes used to support the upstream ends of the liners is to mount the liners to the combustor dome panel via a number of support pins extending between the inner and outer combustor casings. More specifically, the dome panel is disposed between the upstream ends of the liners and the support pins are inserted through aligned openings in the dome panel, liners and casings. However, misalignments between the support pins and the openings may potentially cause deformation and/or the formation of localized stresses. Another technique used to support the combustor liners is to mount the liners directly to the inner and outer combustor casings via a number of mounting arms. The mounting arms are typically configured to allow the combustor liners to float relative to the inner and outer casings to accommodate for different rates of thermal expansion and contraction. However, misalignments between the combustor liners, casings and mounting arms may also cause deformation and the buildup of localized stresses.

Thus, a need remains for further contributions in the area of combustor technology. The present invention satisfies this need in a novel and non-obvious way.

SUMMARY OF THE INVENTION

One form of the present invention contemplates a combustor apparatus adapted to support combustor liners in spaced relation to define a combustor chamber.

Another form of the present invention contemplates a combustor apparatus adapted to shield at least a portion of a support structure from fluid flowing through a flowpath.

In yet another form of the present invention, a combustor apparatus includes a combustor liner support adapted to maintain first and second combustor liners in spaced relation. The combustor liner support has a shroud portion extending into a flowpath defined between first and second flowpath structures maintained in spaced relation by a support member. The shroud portion is disposed adjacent the support member to shield at least a portion of the support member from fluid flowing through the flowpath.

In a further form of the present invention, a gas turbine engine combustor includes inner and outer combustor casings interconnected by a support structure with inner and outer combustor liners disposed therebetween, and a combustor liner support having a dome member adapted to maintain the inner and outer combustor liners in spaced relation to define a combustion chamber. The combustor liner support has a load transfer member extending from the dome member. The load transfer member is coupled to at least one of the inner and outer casings and is adapted to cover at least a portion of the support structure.

In a further form of the present invention, a gas turbine engine includes a diffuser section having an inner wall spaced from an outer wall to define an annular flowpath and being coupled together by a plurality of struts, and a combustor section having inner and outer combustor liners and a combustor liner support. The combustor liner support includes an annular dome panel and a plurality of load transfer members extending therefrom, with the dome panel being adapted to maintain the inner and outer combustor liners in spaced relation to define a combustion chamber. The load transfer members extend into the flowpath to shield at least a portion of each strut from fluid flowing through the flowpath.

In a further form of the present invention, a gas turbine engine includes a diffuser having inner and outer walls spaced apart to define a flowpath with means for transmitting loads between the inner and outer walls, and means for supporting inner and outer combustor liners in spaced relation to define a combustion chamber. The supporting means including means for substantially isolating the load transmitting means from the flowpath.

One object of the present invention is to provide a unique combustor apparatus for a gas turbine engine.

Further forms and embodiments of the present invention shall become apparent from the drawings and descriptions provided herein.

DESCRIPTION OF THE PREFERRED EMBODIMENTS

Figure 1:
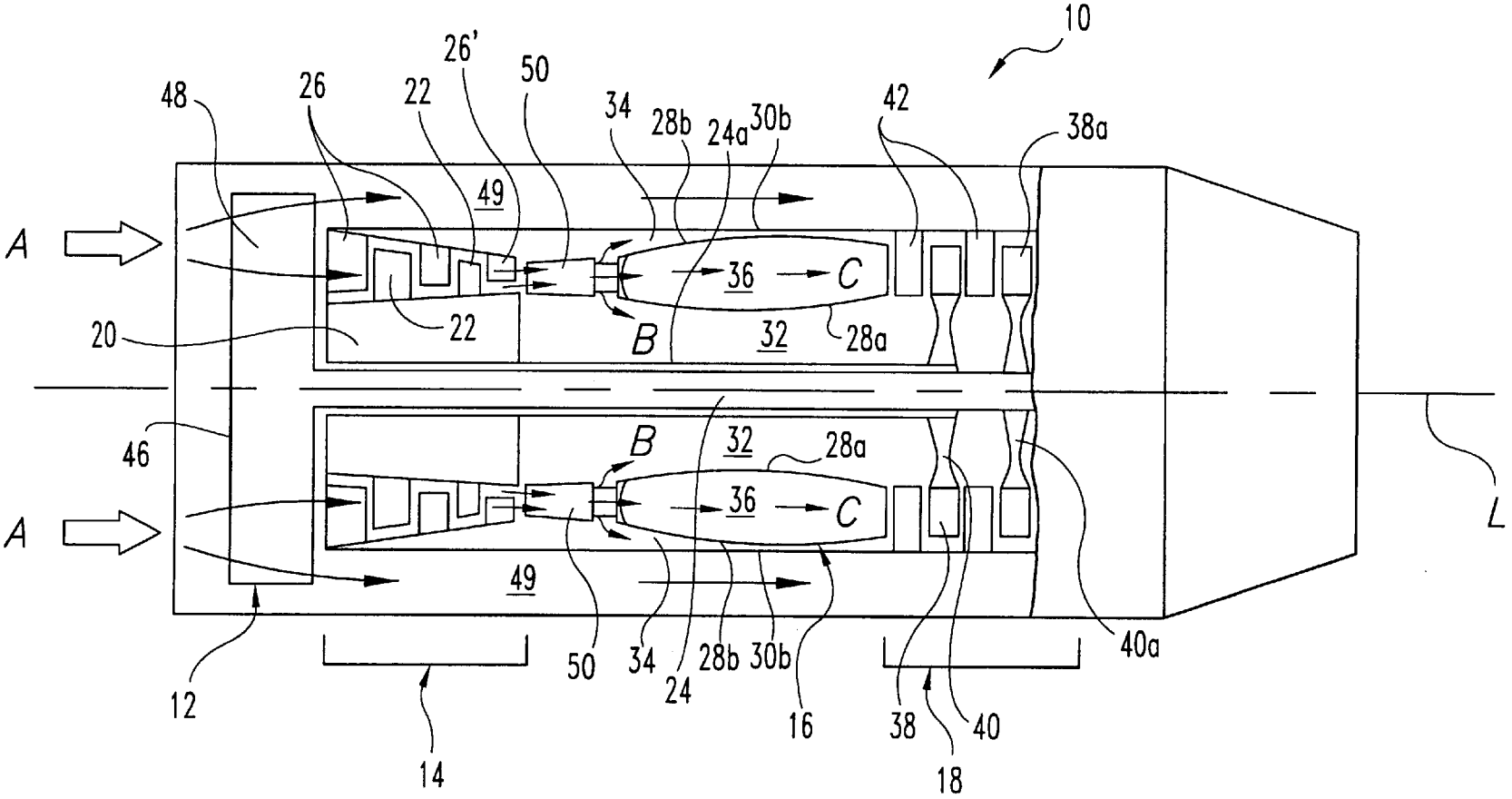
FIG. 1 is a schematic representation of a gas turbine engine.

For the purposes of promoting an understanding of the principals of the invention, reference will now be made to the embodiment illustrated in the drawings and specific language will be used to describe the same. It will nevertheless be understood that no limitation of the scope of the invention is hereby intended, and any alterations and further modifications of the illustrated device, and any further applications of the principals of the invention as illustrated herein being contemplated as would normally occur to one skilled in the art to which the invention relates.

With reference to FIG. 1, there is illustrated a schematic representation of a gas turbine engine 10. However, it should be understood that the invention described herein is applicable to all types of gas turbine engines and is not intended to be limited to the gas turbine engine schematic represented in FIG. 1. In one form, gas turbine engine 10 includes a longitudinal axis L extending generally along the gaseous flow stream and has an annular configuration; however, other configurations are also contemplated as would occur to one of ordinary skill in the art. Gas turbine engine 10 includes a fan section 12, a compressor section 14, a combustor section 16, and a turbine section 18 integrated to produce an aircraft flight propulsion engine. This particular form of a gas turbine engine is generally referred to as a turbo-fan. Another form of a gas turbine engine includes a compressor section, a combustor section, and a turbine section integrated to produce an aircraft flight propulsion engine without a fan section.

It should be understood that the term aircraft is generic, and is meant to include helicopters, airplanes, missiles, unmanned space devices and other substantially similar devices. It is also important to realize that there are a multitude of ways in which the gas turbine engine components can be linked together to produce a flight propulsion engine. For instance, additional compressor and turbine stages could be added with intercoolers connected between the compressor stages. Additionally, although gas turbine engine 10 has been described for use with an aircraft, it should be understood that gas turbine engine are equally suited to be used in industrial applications, such as pumping sets for gas and oil transmission lines, electricity generation, and naval propulsion. Further, gas turbine engines are applicable to vehicle technology.

The multi-stage compressor section 14 includes a rotor 20 having a plurality of compressor blades 22 coupled thereto. The rotor 20 is affixed to a shaft 24*a* which is rotatably mounted within gas turbine engine 10. A plurality of compressor vanes 26 are positioned adjacent the compressor blades 22 to direct the flow of gaseous fluid through the compressor section 14. In a preferred embodiment, the gaseous fluid is air; however, the present invention also contemplates other gaseous fluids. Located at the downstream end of the compressor section 14 is a series of compressor outlet vanes 26' for directing the flow of air into a diffuser 50. Diffuser 50 conditions the compressed air and discharges the conditioned air into combustor section 16 for subsequent combustion.

The combustor section 16 includes inner and outer combustor liners 28*a*, 28*b* spaced apart to define a combustion chamber 36 therebetween. In one form, the inner combustor liner 28*a* is spaced from shaft 24*a*, or preferably from an inner combustor casing 30*a* (FIG. 2), to define an annular fluid passage 32. The outer combustor liner 28*b* is preferably spaced from an outer casing 30*b* to define an annular fluid passage 34. Turbine section 18 includes a plurality of turbine blades 38 coupled to a rotor disk 40, which in turn is affixed to shaft 24. A plurality of turbine blades 38*a* are coupled to a rotor disc 40*a*, which in turn is affixed to shaft 24. A plurality of turbine vanes 42 are positioned adjacent the turbine blades 38, 38*a* to direct the flow of the hot gaseous fluid stream generated by combustor section 16 through turbine section 18. In one form of the present invention, the hot gaseous fluid stream is air; however, the hot gaseous fluid stream could also be, but is not limited to, Hydrogen and/or Oxygen.

In operation, the turbine section 18 provides rotational power to shafts 24 and 24*a*, which in turn drive the fan section 12 and the compressor section 14, respectively. The fan section 12 includes a fan 46 having a plurality of fan blades 48. Air enters the gas turbine engine 10 in the direction of arrows A, passes through fan section 12, and is fed into the compressor section 14 and a bypass duct 49. A significant portion of the compressed air exiting compressor section 14 is routed into the diffuser 50. Diffuser 50 conditions the compressed air and directs the conditioned air into combustion chamber 36 and the fluid passages 32, 34 in the direction of arrows B.

A significant portion of the conditioned air enters the combustion chamber 36 at its upstream end, where the conditioned air is intermixed with fuel to provide an air/fuel mixture. The air/fuel mixture is ignited and burned in combustion chamber 36 to generate a hot gaseous fluid stream flowing through combustion chamber 36 in the direction of arrows C. The hot gaseous fluid stream is fed into the turbine section 18 to provide the energy necessary to power gas turbine engine 10. The remaining portion of the conditioned air exiting diffuser 50 flows through the fluid passages 32, 34 to cool the inner and outer combustor liners 28*a*, 28*b* and other engine components. Further details regarding the general structure and operation of a gas turbine engine are believed well known to those skilled in the art and are therefore deemed unnecessary for a full understanding of the principles of the present invention.

Figure 2:
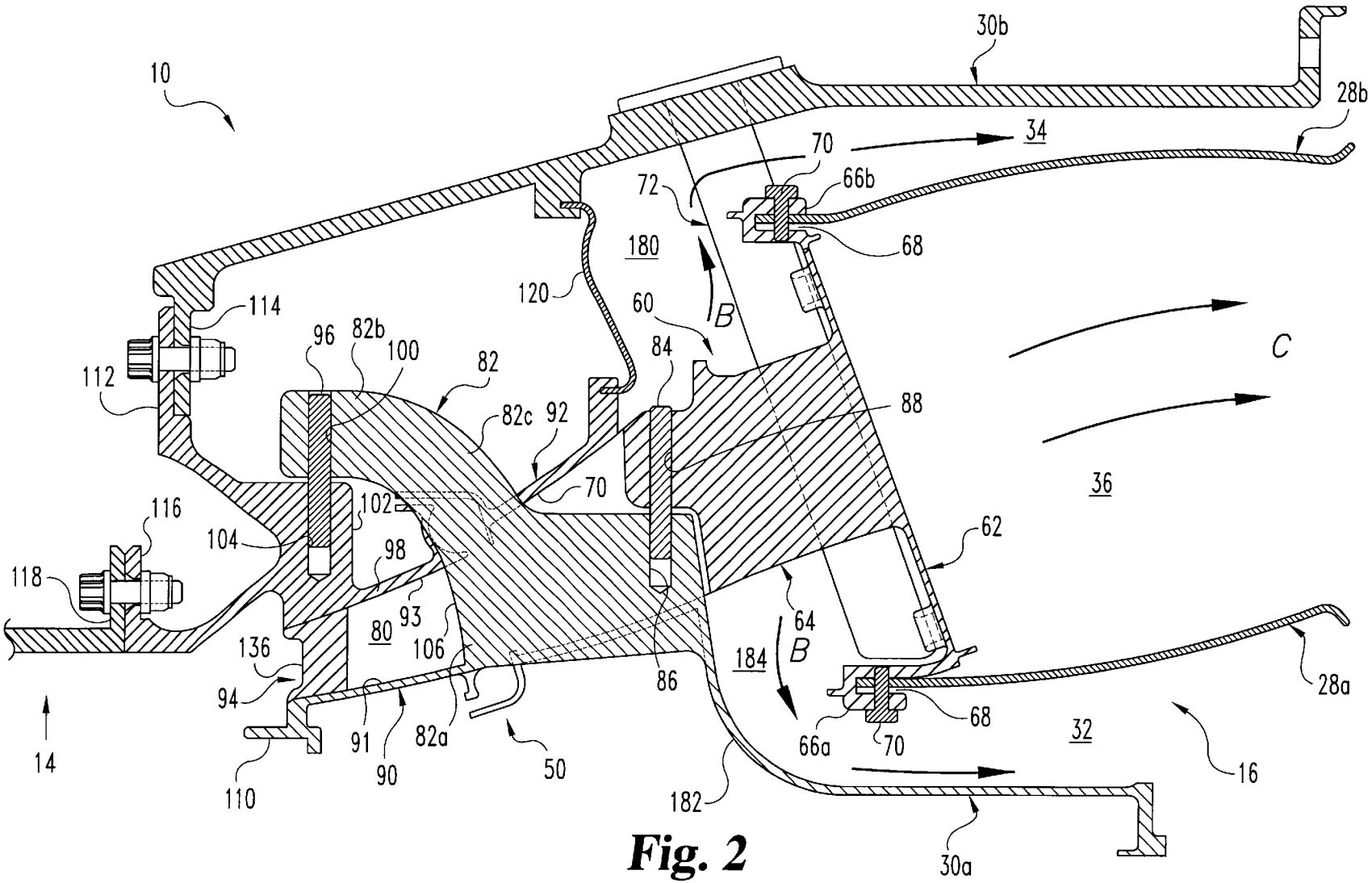
FIG. 2 is a partial sectional view of a portion of a gas turbine engine, illustrating a combustor apparatus according to one form of the present invention.

Referring to FIG. 2, there is illustrated a cross sectional view of a portion of gas turbine engine 10, illustrating a combustor apparatus according to one form of the present invention. The combustor apparatus is generally comprised of inner and outer combustor liners 28*a*, 28*b* and a combustor liner support member 60. The combustor liner support member 60 includes a combustor dome panel 62 and at least one load transfer member 64. In one form of the present invention, the dome panel 62 extends annularly about longitudinal axis L, with a plurality of the load transfer members 64 extending substantially axially from and spaced uniformly about dome panel 62. However, in an alternative form of the present invention, the load transfer members are not spaced uniformly about dome panel 62. In one embodiment, the dome panel 62 and the load transfer members 64 are integrally formed to define a single-piece unitary structure. However, it should be understood that dome panel 62 and load transfer members 64 may be formed separately and interconnected by any method know to those of skill in the art, such as, for example, by welding or fastening. In one embodiment, dome panel 62 is comprised of a number of individual panel segments that are attached to the inner combustor casing. A seal is positioned between adjacent panel segments to close any gap there between. The components of combustor liner support 60 may be formed of conventional materials as would be known to one of ordinary skill in the art; materials such as, but not limited to, Waspalloy, Inconel.

The dome panel 62 is configured to support the inner and outer combustor liners 28*a*, 28*b* in spaced relation to define combustion chamber 36. Although combustor chamber 36 is illustrated and described as having an annular configuration, it should be understood that the present invention is also applicable to combustors having other configurations, such as, for example, a can or can-annular configuration. In one form of the present invention, the inner and outer liners 28*a*, 28*b* are independently attached to dome panel 62 by inner and outer liner attachment members 66*a*, 66*b*. In one embodiment, the upstream ends of liners 28*a*, 28*b* are captured within axial grooves 68 formed in each liner attachment 66*a*, 66*b* by a plurality of fasteners 70. Liner loads are thereby taken out by the dome panel 62 and conveyed through the load transfer members 64. As will be discussed more fully below, the load transfer members 64 transfer the liner loads to the inner and outer combustor casings 30*a*, 30*b*. In another form of the present invention, the dome panel 62 is configured to support a number of fuel nozzles or spraybars 72 which are used to inject fuel into combustion chamber 36 in a conventional manner, the details of which will be discussed below.

Referring collectively to FIGS. 2–6, in one embodiment of combustor liner support 60, each of the load transfer members 64 includes a passage or slot 80 sized to receive at least a portion of a separate support structure 82 therethrough. In one form of the present invention, the support structure 82 is a strut adapted to transfer loads between the inner and outer combustor casings 30*a*, 30*b*. As will be discussed in further detail below, each load transfer member 64 is configured to shield at least a portion of a corresponding strut 82 from fluid flowing through diffuser 50.

In one form of the present invention, each load transfer member 64 is coupled to a corresponding strut 82 by a pin 84 extending between an opening 86 in strut 82 and an opening 88 in load transfer member 64. In one embodiment, each opening 86, 88 extends in a generally radial direction, and at least one of the openings 86, 88 has a diameter slightly larger than the outer diameter of pin 84 to allow sliding movement therebetween. It should be understood that pin 84 could alternatively be configured as a bolt having a non-threaded portion within opening 88 and a threaded shank portion adapted to engage internal threads defined within opening 86. By pinning load transfer member 64 to strut 82 at a single axial location, rather than at multiple axial locations, axially induced thermal stresses are reduced, if not eliminated entirely. Additionally, because load transfer member 64 is allowed to float relative to strut 82 in a radial direction, the buildup of radially induced thermal load stresses is also reduced.

Diffuser 50 is adapted to receive an increased pressure fluid from compressor section 14 and direct at least a portion of the fluid into combustor section 16 for subsequent combustion within combustion chamber 36. In one form of the present invention, diffuser 50 includes an inner flowpath structure 90 defining an inner flowpath wall 91 and an outer flowpath structure 92 defining an outer flowpath wall 93. The inner flowpath structure 90 is coupled to the outer flowpath structure 92 by way of struts 82. Struts 82 maintain the inner and outer flowpath walls 91, 93 in spaced relation to define a diffuser flowpath 94 while allowing for relative displacement between flowpath walls 91, 93 in at least one direction. In one embodiment, the struts 82 allow for relative displacement between flowpath walls 91, 93 in a radial direction.

Each strut 82 includes a first end portion 82*a* connected to the inner flowpath structure 90, a second end portion 82*b* coupled to the outer flowpath structure 92 by a pin or fastener 96, and an intermediate neck portion 82*c* interconnecting the first and second end portions 82*a*, 82*b*. First end portion 82*a* of strut 82 extends outwardly from inner flowpath wall 91 in a generally radial direction and is substantially rigidly attached thereto by any method known to one of ordinary skill in the art, such as, for example, by welding or fastening or integrally cast. The outer flowpath wall 93 defines an aperture or slot 98 (FIG. 5) having a length extending in a generally axial direction and being sized to receive the second end portion 82*b* and neck portion 82*c* of strut 82 therethrough. Second end portion 82*b* of strut 82 includes an opening 100 sized to receive pin 96 therein. The outer flowpath structure 92 has a shoulder 102 extending outwardly from outer flowpath wall 93 and including an opening 104 sized to receive pin 96 therein. In one embodiment, each opening 100, 104 extends in a generally radial direction, and at least one of the openings 100, 104 has a diameter slightly larger than the outer diameter of pin 96 to allow sliding movement therebetween. The non-rigid connection between strut 82 and outer flowpath structure 92 allows for independent radial expansion and contraction of the inner and outer flowpath structures 90, 92 to accommodate for thermal transients within gas turbine engine 10 and to minimize the buildup of thermal stresses within diffuser 50.

In addition to being interconnected by struts 82, the inner and outer flowpath structures 90, 92 are preferably secured to adjacent structures of gas turbine engine 10. In one form of the present invention, the upstream end portion of inner flowpath structure 90 includes a mounting flange 110 which may be attached, for example, to a portion of the compressor section 14. In one embodiment, the inner flowpath structure 90 is integrally formed with the inner combustor casing 30*a* to define a single-piece structure. The upstream end portion of outer flowpath structure 92 includes a first mounting flange 112 attached to a corresponding flange 114 of outer casing 30*b*, and a second mounting flange 116 attached to a corresponding flange 118 of the compressor section 14. In one embodiment, an annular sealing element 120 extends between the downstream end portion of outer flowpath structure 92 and the outer casing 30*b*, the function of which will be discussed below. Further details regarding diffuser 50 are disclosed in co-pending patent application Ser. No. 09/708,930 filed on Nov. 8, 2000 by inventors Rice and Froemming. This co-pending patent application is hereby expressly incorporated by reference for its entire disclosure.

In one form of the present invention, each load transfer member 64 is configured to surround at least a portion of a corresponding strut 82 to shield strut 82 from fluid flowing through diffuser flowpath 94. More specifically, portion 82*a* of strut 82 is disposed within the passage 80 extending through load transfer member 64. In this manner, load transfer member 64 acts as a shroud to thermally isolate strut 82 from the fluid flowing through diffuser flowpath 94. It should be understood that the phrase "thermally isolate", as used herein, does not necessarily mean the complete absence of heat transfer, but is instead meant to include the substantial separation or isolation of at least a portion of a strut 82 from fluid flow. Because the leading edge 106 of strut 82 would otherwise be exposed to the direct impingement of fluid, leading edge 106 is shielded from flowpath 94 to minimize thermal gradients and stresses across strut 82, particularly during thermal cycling of gas turbine engine 10.

Figure 3:
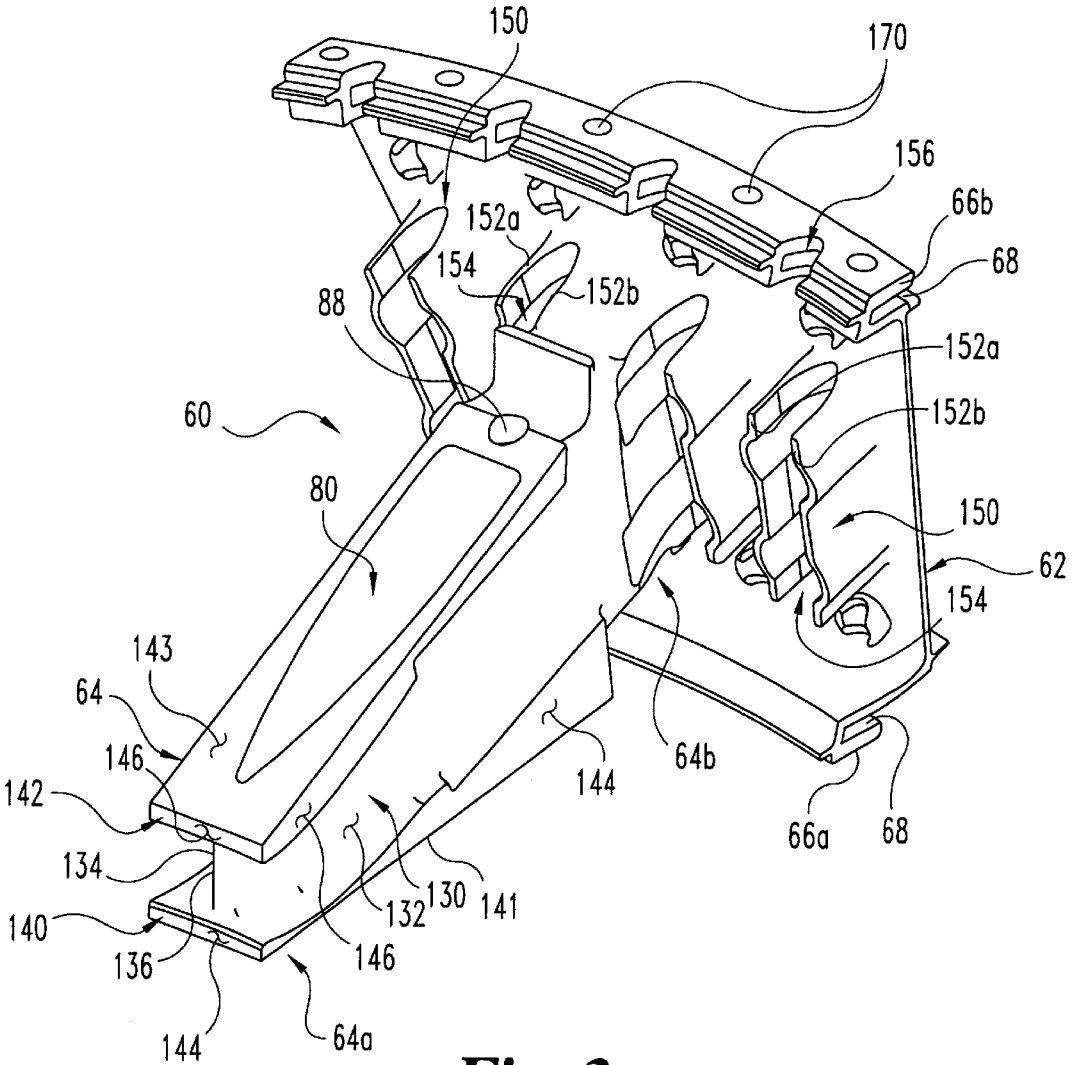
FIG. 3 is a front perspective view of a portion of the combustor apparatus illustrated in FIG. 2.
Figure 4:
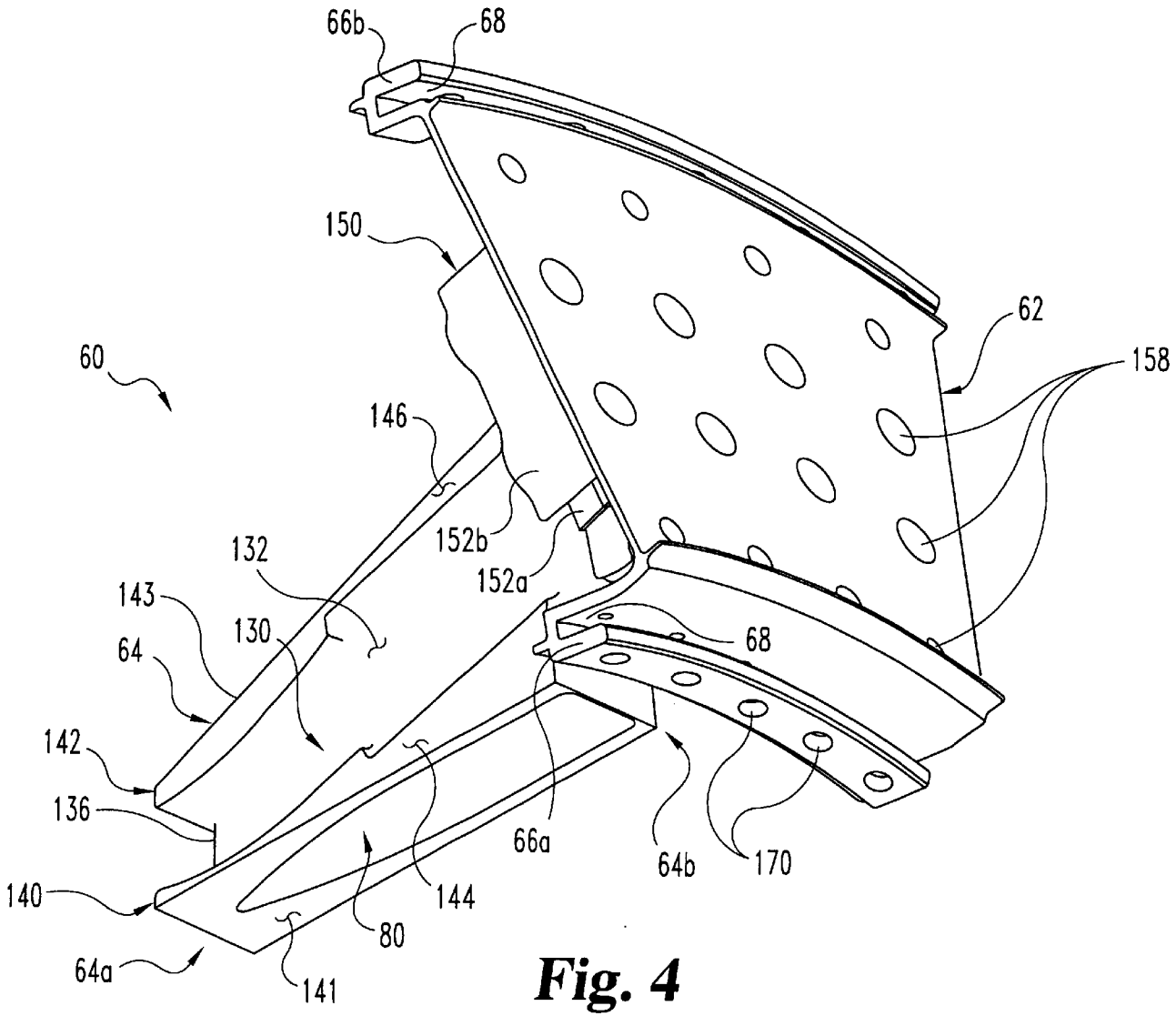
FIG. 4 is a rear perspective view of a portion of the combustor apparatus illustrated in FIG. 2.

Referring specifically to FIGS. 3 and 4, there are shown further details regarding combustor liner support member 60. In one form of the present invention, load transfer member 64 has an aerodynamic shape to minimize fluid turbulence and aerodynamic drag of the fluid flowing through diffuser flowpath 94. Load transfer member 64 has an upstream end portion 64*a*, a downstream end portion 64*b*, and a web portion 130 extending between end portions 64*a*, 64*b*. Web portion 130 includes a pair of opposite, laterally facing surfaces 132, 134 which converge at upstream end portion 64*a* to define an upstream edge 136, and taper away from one another as they extend toward downstream end portion 64*b* to define an aerodynamic V-shape. In the illustrated embodiment, upstream edge 136 is pointed; however, it should be understood that leading edge 136 can also take on other configurations, such as, for example, a flattened or rounded shape.

Load transfer member 64 also includes inner and outer flange portions 140, 142 disposed at opposite ends of web portion 130. Flange portions 140, 142 define inwardly and outwardly facing surfaces 141, 143, respectively, which diverge away from one another as they extend from upstream end portion 64*a* toward downstream end portion 64*b*. Flange portions 140, 142 also respectively define peripheral edges 144, 146 extending about inner and outer surfaces 141, 143, respectively. Passage 80 opens onto each of the inner and outer surfaces 141, 143 and extends axially along a substantial portion of the length of load transfer member 64. In one embodiment, passage 80 has a shape corresponding to the outer profile of lateral surfaces 132, 134 so as to define a substantially uniform wall thickness of web portion 130.

In one form of the present invention, dome panel 62 includes a series of spraybar guides 150, each defining a pair of oppositely disposed flanges 152*a*, 152*b* spaced apart to define a channel 154 sized to receive a corresponding fuel spraybar 72 therein (see FIG. 2). The outer liner attachment 66*b* defines a plurality of notches 156, with each notch 156 being aligned with a corresponding channel 154 and sized to receive a corresponding spraybar 72 therethrough. Channels 154 and notches 156 aid in maintaining spraybars 72 in a predetermined position and orientation while allowing for relative movement between dome panel 62 and spraybars 72 in a radial direction. As shown in FIG. 4, dome panel 62 also defines a series of fuel delivery openings 158, each series of openings 158 being aligned with a corresponding spraybar guide 150. Fuel is delivered through spraybars 72 in a conventional manner and is injected or sprayed through fuel delivery openings 158 and into combustion chamber 36. The fuel is intermixed with air from diffuser 50 to form an air/fuel mixture. During operation, air flows between spraybar 72 and gaps in spraybar guide 154. The air flows into the combustion chamber 36 through the plurality of holes 158. At the same time fuel is injected into the airstream flowing through the plurality of holes 158. The air/fuel mixture is ignited by conventional means, such as by an electronic igniter, and is burned within combustion chamber 36 to generate a high temperature gaseous fluid stream.

Figure 5:
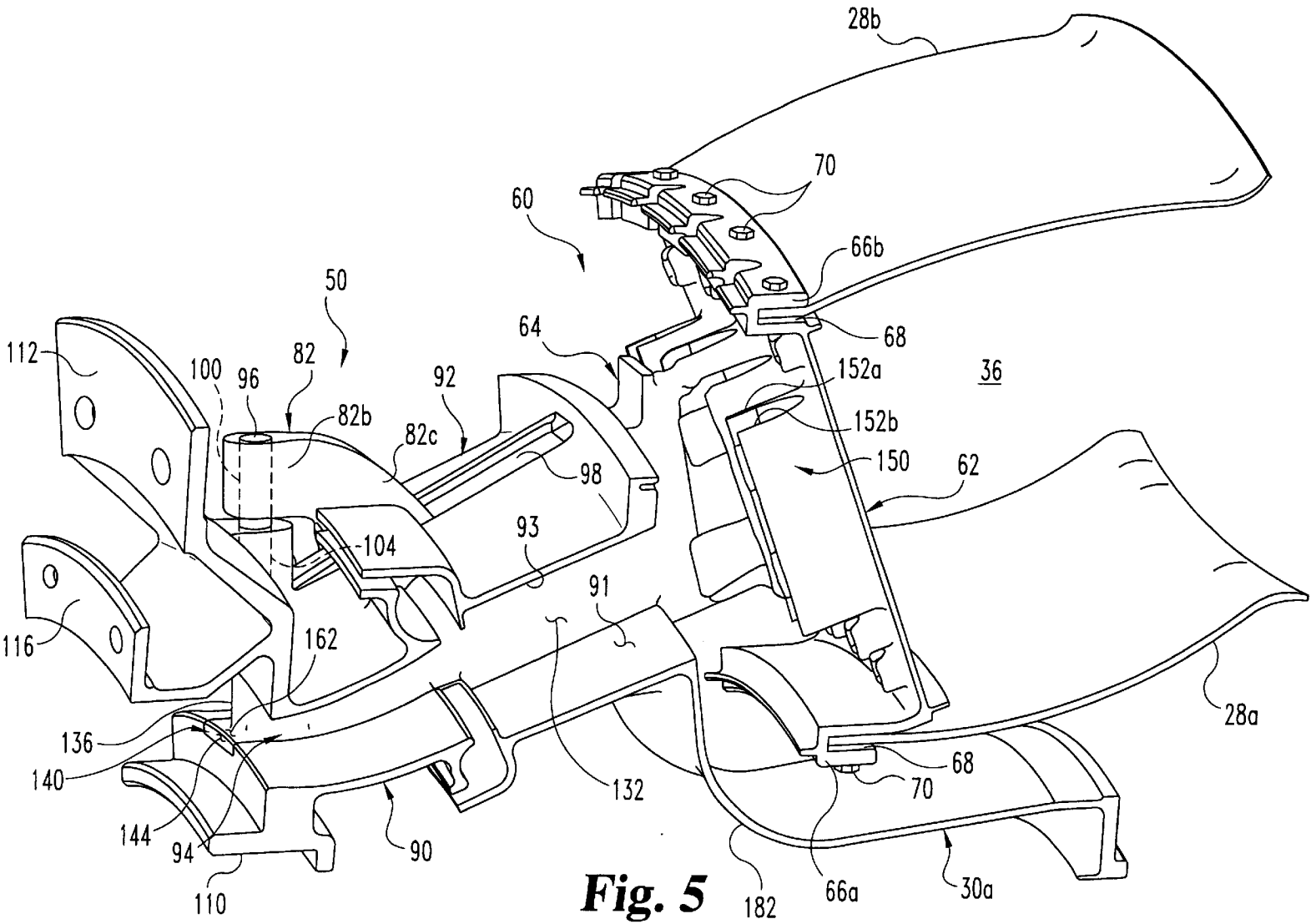
FIG. 5 is a side perspective view of the combustor apparatus illustrated in FIG. 2, as assembled in relation to one form of a diffuser.
Figure 6:
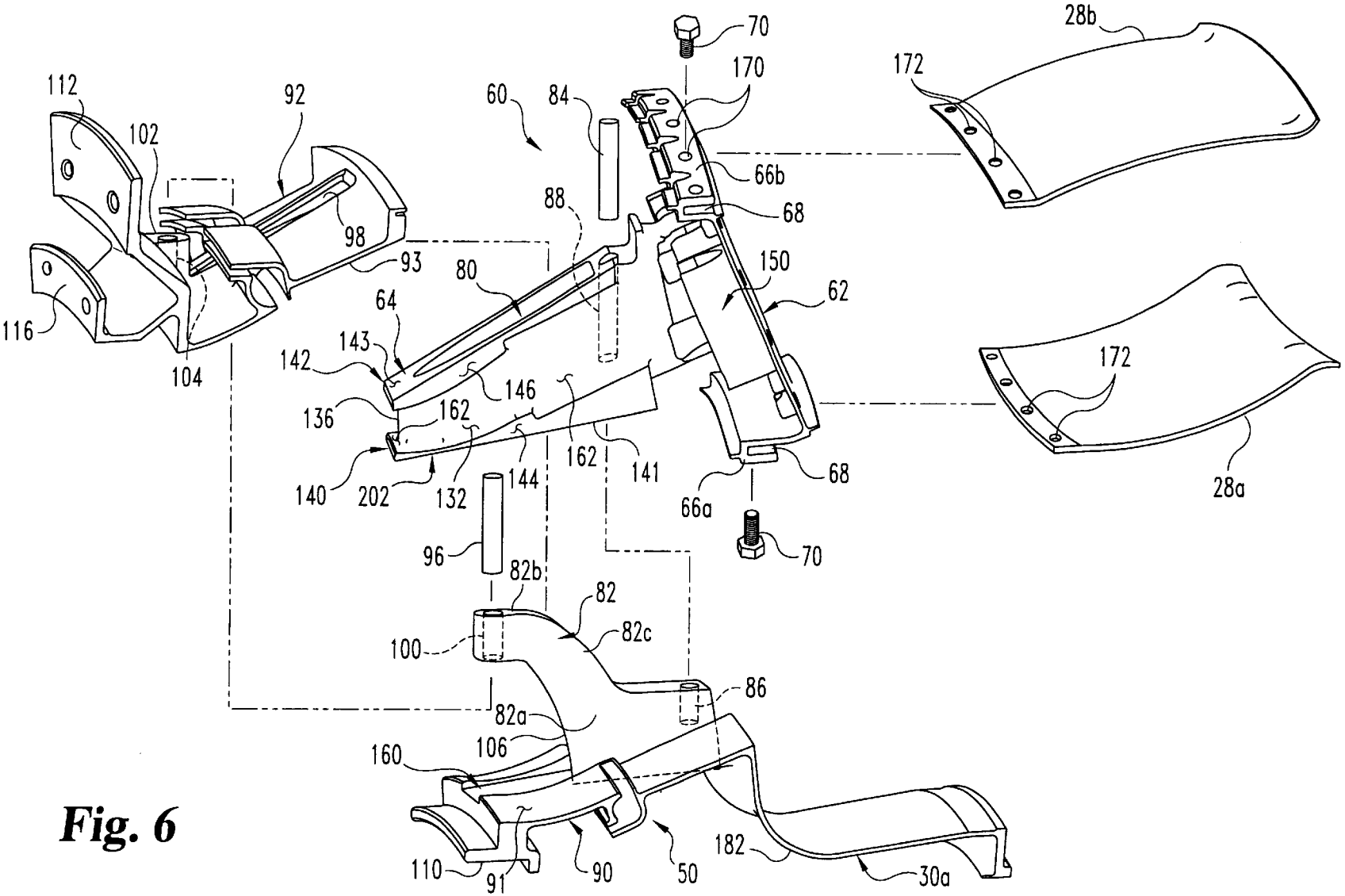
FIG. 6 is an exploded side perspective view of the combustor apparatus and diffuser assembly illustrated in FIG. 5.

Referring to FIGS. 5 and 6, reference will now be made to one method of assembling diffuser 50, combustor liner support 60, and combustor liners 28*a*, 28*b*. However, it should be understood that other methods of assembly are also contemplated as being within the scope of the invention. In one form of the present invention, strut 82 is inserted through a corresponding passage 80 in load transfer member 64, with the inner flange portion 140 of load transfer member 64 being positioned within an axial notch 160 extending along inner flowpath wall 91. The axial notch 160 preferably has a profile substantially complimentary to the peripheral edges 144 of inner flange portion 140. When the inner flange portion 140 is inserted within axial notch 160, the outwardly facing surface 162 of inner flange portion 140 is arranged substantially flush with the inner flowpath wall 91 to provide a relatively smooth transition between load transfer member 64 and inner flowpath structure 90 (see FIG. 5). The load transfer member 64 is then coupled to the inner flowpath structure 90 by inserting pin 84 within aligned openings 86, 88.

Following the assembly of inner flowpath structure 90 and load transfer member 64, the outer flowpath structures 92 may then be coupled to strut 82. More specifically, the neck portion 82*c* of strut 82 is inserted through slot 98 in outer flowpath structure 92, with the second end portion 82*b* of strut 82 positioned outwardly adjacent shoulder 102. The outer flange portion 142 of load transfer member 64 is positioned within an axial notch (not shown) extending along outer flowpath wall 93 and preferably having a profile substantially complementary to the peripheral edges 146 of outer flange portion 142. When the outer flange portion 142 is inserted within the axial notch, the inwardly facing surface 164 of outer flange portion 142 is arranged substantially flush with the outer flowpath wall 93 to provide a relatively smooth transition between load transfer member 64 and outer flowpath structure 92. The outer flowpath structure 92 is then coupled to strut 82 by inserting pin 96 within aligned openings 100, 102, which correspondingly couples the inner and outer flowpath structures 90, 92 while allowing relative displacement therebetween in a generally radial direction.

Following the assembly of diffuser 50 and combustor liner support 60, the inner and outer combustor liners 28*a*, 28*b* are attached to dome panel 62. The upstream ends of liners 28*a*, 28*b* are inserted within the axial grooves 68 defined in the inner and outer liner attachments 66*a*, 66*b*. In one embodiment, openings 170 in liner attachments 66*a*, 66*b* are aligned with openings 172 in the upstream ends of liners 28*a*, 28*b* and a fastener 70 is inserted through each corresponding pair of aligned openings 170, 172 to independently attach liners 28*a*, 28*b* to dome panel 62. Although one specific method of attaching combustor liners 28*a*, 28*b* to the dome panel 62 has been illustrated and described herein, it should be understood that other means of attachment are also contemplated as would occur to one of ordinary skill in the art.

Referring once again to FIG. 2, the sealing element 120 is installed between the outer flowpath structure 92 and the outer combustor casing 30*b* to form a fluid passage 180 between the downstream end of diffuser 50 and the annular fluid passage 34. The inner combustor casing 30*a* includes an annular portion 182 extending from the inner flowpath structure 90 to form a fluid passage 184 between the downstream end of diffuser 50 and the annular fluid passage 32. Although a substantial portion of the conditioned air exiting diffuser 50 is fed into the combustion chamber 36, a portion of the air is directed through fluid passage 180 in the direction of arrow B and into the annular fluid passage 34. Additionally, a portion of the air is directed through fluid passage 184 in the direction of arrow B and into the annular fluid passage 32. The air flowing through passages 32, 34 serves to provide cooling to the combustor liners 28*a*, 28*b* and other engine components.

During operation of gas turbine engine 10, diffuser 50 receives increased pressure fluid from compressor section 14, conditions the fluid for subsequent combustion, and delivers the fluid to combustor section 16. Because of the thermal cycling inherent in engine 10, portions of diffuser 50, such as struts 82, may otherwise be exposed to transient thermal loading, particularly during acceleration and deceleration of engine 10. However, struts 82 are shielded from the fluid flowing through diffuser flowpath 94 by load transfer members 64, thereby substantially isolating strut 82 from thermal transients and minimizing thermal gradients and localized thermal stresses across diffuser 50. Because the inner and outer combustor liners 28*a*, 28*b* are attached to dome panel 62, independent of the inner and outer combustor casings 30*a*, 30*b*, there is no need to align various features of the liners 28*a*, 28*b* with corresponding features of casings 30*a*, 30*b*.

While the invention has been illustrated and described in detail in the drawings and foregoing description, the same is to be considered as illustrative and not restrictive in character, it being understood that the preferred embodiments have been shown and described and that all changes and modifications that come within the spirit of the invention are desired to be protected. In reading the claims it is intended that when words such as "a", "an", "at least one", "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A combustor apparatus, comprising:

a combustor liner support adapted to maintain first and second combustor liners in spaced relation, said combustor liner support having a shroud portion extending into a flowpath defined between first and second flowpath structures maintained in spaced relation by a support member at least partially disposed within said flowpath, said shroud portion being disposed adjacent said support member to shield at least a portion of said support member from fluid flowing through said flowpath.

2. The combustor apparatus of claim 1 wherein said shroud portion isolates said at least a portion of said support member from thermal transients.

3. The combustor apparatus of claim 1 wherein said shroud portion is disposed about a leading edge of said support member to shield said leading edge from said fluid flowing through said flowpath.

4. The combustor apparatus of claim 3 wherein said shroud portion defines a passage extending therethrough, said support member extending through said passage to isolate said support member from said flowpath.

5. The combustor apparatus of claim 4 wherein said shroud portion thermally isolates said support member from said fluid flowing through said flowpath.

6. The combustor apparatus of claim 1 wherein said shroud portion has an upstream end portion and a downstream end portion, said upstream end portion defining a leading edge tapering outwardly toward said downstream end portion.

7. The combustor apparatus of claim 1 wherein said combustor liner support includes a dome portion adapted to support said first and second combustor liners in spaced relation to define a combustion chamber.

8. The combustor apparatus of claim 7 wherein said dome portion includes a pair of spaced apart grooves, an upstream end portion of each of said first and second combustor liners being captured within a respective one of said grooves.

9. The combustor apparatus of claim 7 wherein said dome portion includes a spraybar guide, said spraybar guide being adapted to maintain a fuel spraybar in a predetermined orientation relative to said dome portion.

10. The combustor apparatus of claim 9 wherein said dome portion includes a plurality of fuel delivery openings extending therethrough and positioned in alignment with said fuel spraybar, said fuel spraybar being adapted to spray fuel through said fuel delivery openings and into said combustion chamber.

11. The combustor apparatus of claim 7 wherein said dome portion is integrally attached to said shroud portion to form a single piece structure.

12. The combustor apparatus of claim 7 wherein said dome portion comprises an annular dome panel, said dome panel supporting said first and second combustor liners in radially spaced relation to define an annular combustion chamber.

13. The combustor apparatus of claim 12 wherein a plurality of said shroud portions extend from said dome panel, said plurality of shroud portions shielding a corresponding plurality of said support members from said fluid flowing through said flowpath.

14. The combustor apparatus of claim 1 wherein said shroud portion is pinned to at least one of said first and second flowpath structures to allow substantially unrestrained relative displacement between said shroud portion and said at least one of said first and second flowpath structures in at least one direction.

15. The combustor apparatus of claim 1 wherein said support member is coupled between said first and second flowpath structures while allowing substantially unrestrained relative displacement between said first and second flowpath structures in at least one direction.

16. The combustor apparatus of claim 1 wherein said first and second flowpath structures are annular shaped and are maintained in radially spaced relation by a plurality of said support members to define an annular diffuser flowpath; and wherein said combustor liner support includes a plurality of said shroud portions disposed within said diffuser flowpath and positioned about respective ones of said plurality of support members to substantially isolate said plurality of support members from fluid flowing through said flowpath.

17. A gas turbine engine combustor, comprising:

inner and outer combustor casings interconnected by a support structure;

inner and outer combustor liners disposed between said inner and outer combustor casings; and a combustor liner support having a dome member adapted to maintain said inner and outer combustor liners in spaced relation to define a combustion chamber, said combustor liner support having a load transfer member extending from said dome member, said load transfer member being coupled to at least one of said inner and outer combustor casings and being adapted to cover at least a portion of said support structure.

18. The combustor of claim 17 wherein said load transfer member is pinned to said support structure.

19. The combustor of claim 17 wherein said support structure is at least partially disposed within a flowpath, said load transfer member shielding said at least a portion of said support structure from fluid flowing through said flowpath.

20. The combustor of claim 19 wherein said load transfer member is disposed about a leading edge of said support structure to shield said leading edge from said fluid flowing through said flowpath.

21. The combustor of claim 20 wherein said load transfer member defines a passage extending therethrough, said support structure extending through said passage to thermally isolate said support structure from said fluid flowing through said flowpath.

22. The combustor of claim 19 further comprising a diffuser having inner and outer flowpath walls maintained in spaced relation by said support structure to define said flowpath.

23. The combustor of claim 22 wherein at least one of said inner and outer flowpath walls are pinned to said support structure to allow relative displacement between said inner and outer flowpath walls in at least one direction.

24. The combustor of claim 22 wherein said inner combustor casing is integrally formed with said inner flowpath wall to define a single piece structure.

25. The combustor of claim 17 wherein said dome member includes a pair of spaced apart grooves, an end portion of each of said inner and outer combustor liners being captured within a respective one of said grooves.

26. The combustor of claim 17 wherein said dome member includes a spraybar support having a pair of opposing flanges adapted to support a fuel spraybar, said dome portion including a plurality of fuel delivery openings extending therethrough and positioned in alignment with said fuel spraybar, said fuel spraybar being adapted to spray fuel through said fuel delivery openings and into said combustion chamber.

27. A gas turbine engine, comprising:

a diffuser section including an inner wall spaced from an outer wall to define an annular flowpath, said inner and outer walls being coupled together by a plurality of struts, said struts being at least partially disposed within said flowpath; and a combustor section including a combustor liner support having an annular dome panel and a plurality of load transfer members extending therefrom, said dome panel being adapted to maintain inner and outer combustor liners in spaced relation to define an annular combustion chamber, each of said load transfer members extending into said flowpath and shielding at least a portion of a respective one of said struts from fluid flowing through said flowpath.

28. The gas turbine engine of claim 27 wherein each of said load transfer members is disposed about a leading edge of said respective one of said struts to shield said leading edge from said fluid flowing through said flowpath.

29. The gas turbine engine of claim 27 wherein each of said load transfer members surrounds said respective one of said struts to thermally isolate said respective one of said struts from said fluid flowing through said flowpath.

30. The gas turbine engine of claim 27 wherein each of said load transfer members is radially pinned to said respective one of said struts to axially couple said combustor liner support to said diffuser section while allowing substantially unrestrained displacement therebetween in a radial direction.

31. The gas turbine engine of claim 27 wherein said dome panel includes a pair of spaced apart annular grooves adapted to receive an upstream end portion of each of said inner and outer combustor liners therein.

32. The gas turbine engine of claim 27 wherein said plurality of struts are pinned to at least one of said inner and outer walls to axially couple said inner wall to said outer wall while allowing relative displacement therebetween in a radial direction.

33. A gas turbine engine, comprising:

a diffuser including inner and outer walls spaced apart to define a flowpath and means for transmitting loads between said inner and outer walls, said load transmitting means being at least partially disposed within said flowpath; and means for supporting inner and outer combustor liners in spaced relation to define a combustion chamber, said supporting means including means for substantially isolating said load transmitting means from said flowpath.

* * * * *